US007374394B2

(12) United States Patent
Lin

(10) Patent No.: US 7,374,394 B2
(45) Date of Patent: May 20, 2008

(54) MULTIFUNCTIONAL BACK-FLOWING STRONG-SUCTION BLOWER

(76) Inventor: Junhao Lin, No. 7-9 Fenghuangtai, Fengyunxiang, Yantai City, Shandong Province (CN) 264002

( * ) Notice: Subject to any disclaimer, the term of this patent is extended or adjusted under 35 U.S.C. 154(b) by 219 days.

(21) Appl. No.: 11/411,202

(22) Filed: Apr. 24, 2006

(65) Prior Publication Data

US 2006/0263211 A1 Nov. 23, 2006

Related U.S. Application Data

(63) Continuation of application No. PCT/CN2004/001178, filed on Oct. 18, 2004.

(30) Foreign Application Priority Data

Oct. 24, 2003 (CN) ..... 2003 2 0104050 U

(51) Int. Cl.
*F04D 27/02* (2006.01)
*F04D 29/28* (2006.01)

(52) U.S. Cl. ..... 415/58.4; 416/181; 416/183

(58) Field of Classification Search ..... 415/203, 415/58.4, 58.2, 58.3; 417/423.2; 416/182, 416/179, 181, 183
See application file for complete search history.

(56) References Cited

U.S. PATENT DOCUMENTS 3,246,605 A * 4/1966 Fisher ..... 415/206

* cited by examiner

*Primary Examiner*—Richard A. Edgar

(57) ABSTRACT

A multifunctional back-flowing strong-suction blower exhibits low energy consumption, mass airflow, enhanced capability of handling polluted material, high efficiency, and low noise. The strong-suction blower may also reduce the risk of pollution and corrosion of the through-flow parts in the blower housing.

20 Claims, 8 Drawing Sheets

MULTIFUNCTIONAL BACK-FLOWING STRONG-SUCTION BLOWER

RELATED APPLICATIONS

This application is a continuation of International Application No. PCT/CN 2004/001178, filed Oct. 18, 2004, which claims benefit of Chinese Patent Application No. CN 200320104050.1, filed Oct. 24, 2003.

FIELD OF THE INVENTION

The present invention relates to the art of air cleaning, especially as it relates to a multifunctional back-flowing strong-suction blower.

BACKGROUND OF THE INVENTION

Today's blowers are not only inefficient but also have high energy consumption and poor capability of handling polluted material. Through-flow parts in the blower housing often become frayed and severely corroded. Many blowers are also noisy and have only one function and limited range of use.

SUMMARY OF THE INVENTION

The object of the present invention is to provide a multifunctional back-flowing strong-suction blower with low energy consumption, mass airflow, enhanced capability of handling polluted material, high efficiency, and low noise, all of which may also reduce the risk of pollution and corrosion of the through-flow parts in the housing.

According to one embodiment, a multifunctional back-flowing strong-suction blower comprises a casing, an impeller, impeller blades, a back-flowing suction port (or "suction port"), and a sidewall air outlet. The suction port in the axial sidewall of the casing faces the axial surface of the side of the impeller, and the edge of the impeller blades include suctionside separating plates. The casing may take many different shapes, including volute, disk, column, or taper; and composite units may be combined into any of several different shapes.

The operating principle of the multifunctional back-flowing strong-suction blower is similar to other kinds of back-flowing suction blowers. The design also uses the suction formed by the high-speed flow in front of and behind the impeller outlet to suck outside material (air, liquid, or solid) into the casing. This blower also uses centrifugal force when an impeller inlet is not provided in the impeller, formed by the rotation of the impeller blade to suck in outside material. The suction formed by the high-speed flow (airflow and liquid flow) processed by the impeller, and the suction formed by the centrifugal force from rotation of the impeller blade directly suck material into the casing through the suction port. The suction port is located in the rear axial sidewall of the casing, located at the longitudinally distal end of a longitudinal axis running between front and real axial sidewalls. The suction port may be located in one or both of the rear and front axial sidewalls of the casing. The front axial sidewall is usually the same sidewall where an electric motor or drive pulley is located to rotationally drive the impeller about the longitudinal axis. The shape of the suction port may be round, arced, or annular.

The suction port faces the rear axial surface of the impeller, while an impeller inlet faces the front axial surface of the impeller and leading outside the casing near the motor.

Thus, material flowing through the suction port can either enter the inside of the impeller or be prevented from entering the inside of the impeller, depending on the size and mass of the material, as will be explained in detail later.

The reason for locating the suctionside separating plates on the edges of the impeller blades is to employ the suction formed by the centrifugal force of the impeller blade inside the impeller to suck in material. Additionally, the suctionside separating plates contribute to the suction on the outside of the impeller, formed by the high-speed material flow in an air duct within the impeller, which passes through a suction clearance or a suction eyelet, to suck in material through the suction port. The air duct is formed by the centrifugal force through the center of the impeller, generally inside of the impeller blades. The suctionside separating plates may also block any material sucked in by the suction port from passing into the air duct, and simultaneously block the outflow of material from the air duct after the material passes the suction port.

Suctionside separating plates are located on one of the back or front axial surface of each impeller blade, and may be parallel with the axial surface of the impeller or be set at an angle to it. The suctionside separating plates on adjacent impeller blades may be connected with each other. The connection may be either direct or indirect. If adjacent suctionside separating plates directly connect with each other, the interconnecting piece may be located on the edge of each impeller blade or between the impeller blades. Such interconnection of suctionside separating plates is similar to a disk-shaped or annular impeller disk. Thus suctionside separating plates can sometimes be replaced by an integral disk-shaped or annual impeller disk. This kind of disk-shaped or annular suctionside separating plate is distinct from the impeller blades of most blowers, which are not fixed. Adjacent suctionside separating plates may also be indirectly connected to each other at the edges of the impeller blades.

A suction clearance is formed between adjacent suctionside separating plates. Each suction clearance is interlinked with the air duct inside the impeller. Adjacent suctionside separating plates may also be configured with one suctionside separating plate on the edge of an impeller blade not connected with another impeller blade, such that suction clearances are formed between each suctionside separating plate and an adjacent impeller blade. In the absence of connection between adjacent suctionside separating plates, the high-speed flow inside the impeller passing the suction clearances produces suction on the outside of the impeller. Also, because of a diversion isolation action achieved by the suctionside separating plates rotating with the impeller, material sucked through the suction port cannot enter the inside of the impeller, and the flow inside the impeller cannot enter the suction port.

No matter which kind of physical design is adopted, each suction clearance is always located between two adjacent impeller blades. The suction clearances may be equidistant from each set of impeller blades or may be closer to either the leading blade or the following blade. To strengthen the rigidity of the impeller blades and the suctionside separating plates, and to ensure there is no deformation when the impeller rotates, one or several reinforced bracings may be added across the suction clearance in the above two structural configurations. The suctionside separating plates on adjacent impeller blades may be indirectly connected by reinforced bracings, thereby interconnecting all the impeller blades and all the suctionside separating plates on the entire impeller, as an integral whole. Thus, when the impeller rotates, deformation is not likely to occur. This structural configuration with reinforced bracings is suitable for making large-scale blower impellers.

If the suctionside separating plates on the edges of adjacent impeller blades are interconnected, one or more suction eyelets through the air duct inside the impeller are located in the front impeller disk between adjacent impeller blades. These suction eyelets can be round, oblong, or any of many other shapes. There may be one suction eyelet or multiple suction eyelets. The high-speed flow inside the impeller passing the suction eyelets produces suction on the suction port. Also, the impeller blade walls between each set of suction eyelets can directly block any outside material from entering the inside of the impeller (in embodiments wherein the impeller includes an impeller inlet). The impeller blade walls may also block the flow of material inside the impeller from entering the suction port.

A blower impeller may have suctionside separating plates connected laterally to the edge of one or both front and rear axial surfaces of the impeller. An impeller may have a suctionside separating plate attached to the entire axial edge of each impeller blade or attach only part of each suctionside separating plate to a single section or to several sections of the axial edge of each impeller blade. The axial surface with the suctionside separating plates may include an impeller disk. If an impeller disk is included, the suctionside separating plates are located on the radial periphery of the disk. If the suctionside separating plates are on the same axial surface of the impeller as the impeller inlet, each suctionside separating plate is located at the radial periphery of the impeller inlet. The impeller disk of the present invention can be completely enclosed (i.e., completely cover the axial surface of the impeller blades), or can be partially enclosed (i.e., the diameter of the impeller disk is less than that of the impeller). Usually the impeller disk will have a diameter that is less than that of the impeller, such that the suctionside separating plates and the suction clearances are on the radial periphery of the impeller disk. Because the diameter of the impeller disk is less than that of the impeller, and because the suction clearances are provided at the periphery of the impeller disk, the impeller mass and weight can be greatly reduced. Thus the present invention saves both resources (materials) and energy.

Suctionside separating plates may be of many different shapes, such as straight, curved, disk-shaped, and annular. Straight or curved suctionside separating plates can be provided on the edge of each impeller blade, or disk-shaped or annular suctionside separating plates can be provided on the edge of each impeller blade. The size, shape, and transverse span of suction clearances and the suction eyelets are determined by the user's need.

The sidewall air outlet can be located in the radial sidewall of the casing, or in the axial sidewall of the casing, or in both the radial and axial sidewalls of the casing. There can be one, two, or more sidewall air outlets. The air outlets can be round, rectangular, annular, curved, or any of many other shapes. Different spools and special conduits can be added to the outside of the sidewall air outlet. The sidewall air outlet in the real axial sidewall of the casing is usually annular or curved, and if in the radial sidewall, the sidewall air outlet is usually round or rectangular. The sidewall air outlet in the radial sidewall of the casing can be located in the radial sidewall of the casing either facing toward or away from the impeller outlet. A "cochlear tongue" is formed by the sidewall air outlet, and extends radially near the radial sidewall of the casing. If the radial sidewall air outlet and the impeller outlet are staggered along the axial direction (or the longitudinal axis), then the impeller outlet and the cochlear tongue will also be staggered along the axial direction, so that the high-speed flow discharged by the impeller outlet is freely discharged out of the casing from the radial sidewall after flowing axially for some distance. Thus, in the entire process of discharge from the impeller to discharge from the casing, material flow is smoother, such that conduction is substantially prevented, thereby significantly reducing aerodynamic noise. That is, the high-speed flow inside the impeller outlet periodically disrupts the cochlear tongue of the air outlet, thereby mitigating the pivot loss of the blower, as well as decreasing the noise of the blower. If the shape of the radial sidewall of the casing around the impeller is cone-shaped, then the pivot loss will be further lessened and the noise will be further lowered.

As discussed, the impeller may include an impeller inlet. The impeller inlet is located at an axial surface of the impeller connected directly with the air duct inside the impeller. The impeller inlet may be located in one of the axial surfaces of the impeller. The impeller inlet and the suction port may be separately located in the two axial sidewalls of the casing, such that the impeller inlet and the suction port are not directly connected with each other. Material sucked in by the suction port does not enter the impeller inlet. When the impeller inlet and the suction port are located in the same axial sidewall of the casing, the impeller inlet may be located inside the suction port (in which case the suction port is usually round), or may be staggered with the suction port along the radial direction but not facing each other (in which case the suction port is usually annular or curved). In the latter two arrangements, the impeller inlet and the suction port both connect with each other; that is, material sucked in by the suction port also enters the impeller inlet.

A sidewall air inlet can also be provided in the axial sidewall of the casing. The sidewall air inlet may be located in one or both front and rear axial sidewalls of the casing. The sidewall air inlet and the suction port may be separately located in the two opposing axial sidewalls of the casing, or may be located in the same axial sidewall. If located in the same axial sidewall, the suction port is located annularly around the sidewall air inlet. Regardless of the arrangement used, the sidewall air inlet and the impeller inlet should be located in the same axial sidewall of the casing. Moreover, the sidewall air inlet and the impeller inlet are positioned face-to-face and are connected to each other. Material sucked in by the sidewall air inlet enters the impeller inlet.

A connecting vessel may be provided on the outside of the casing and may include an inlet that couples the connecting vessel to the sidewall air outlet of the blower. The connecting vessel inlet may be separately coupled to both the sidewall air inlet of the blower and the suction port, or the connecting vessel may be coupled to both the sidewall air inlet of the blower and the suction port. The connecting vessel can be any of various forms, including vessels shaped like tubes, boxes, or sacks, and may be either totally or partially enclosed. If the connecting vessel is not totally enclosed, filtration and aeration equipment may be located on the sidewall of the connecting vessel. Depending on the shape of the connecting vessel, the blower can circularly suck in and filtrate material in order to perform special applications.

The outstanding features of the blower embodiments include a strong-suction force and a large suction capacity. With the suctionside separating plates, the suction on the outside of the impeller is formed by the suction clearances inside the impeller (when an impeller inlet is not provided in the impeller), and the suction formed by the inside of the impeller and the high-speed flow outside the impeller outlet is most effective for sucking in material. Thus the suction force and suction capacity are much greater than those of general blowers and back-flowing blowers. Because this technique can directly use the suction formed by the high-speed flow that is processed by the impeller to suck in outside material, it has very high efficiency and excellent energy savings.

If the sidewall air inlet and the suction port suck the same type of material, the suction force and the flux will be augmented without increasing power consumed. If the sidewall air inlet and the suction port suck different types of material, the blowers may have varying functions. For example, if the sidewall air inlet sucks pure air and clean liquid, and the suction port sucks both polluted and unpolluted material, because the polluted material does not enter the impeller, the impeller is protected from pollution and corrosion.

To summarize, compared with existing blowers, the embodiments herein disclosed have the advantages of greater ability to handle polluted material, high efficiency, low energy consumption, low noise, multifunctionality, and reduced risk of damage to and corrosion of the through-flow parts in the housing. Some embodiments may also be used in forms of oil pumps and water pumps that will have impellers substantially free of fraying, corrosion, and pollution. These and other advantages of various embodiments will be apparent upon reading the following.

BRIEF DESCRIPTION OF THE DRAWINGS

The present embodiments will become more fully apparent from the following description and appended claims, taken in conjunction with the accompanying drawings. Understanding that the accompanying drawings depict only typical embodiments and are therefore not to be considered to limit the scope of the disclosure, the embodiments will be described and explained with specificity and detail in reference to the accompanying drawings, herein described.

DESCRIPTION OF PREFERRED EMBODIMENTS

The embodiments of this disclosure will be best understood by reference to the drawings, wherein like parts are designated by like numerals throughout. It will be readily understood that the components of the embodiments as generally described and illustrated in the figures herein could be arranged and designed in a wide variety of different configurations. Thus, the following more detailed description of various embodiments, as represented in the figures, is not intended to limit the scope of the invention, as claimed, but is merely representative of various embodiments. While the various aspects of the embodiments are presented in drawings, the drawings are not necessarily drawn to scale unless specifically indicated.

Figure 1:
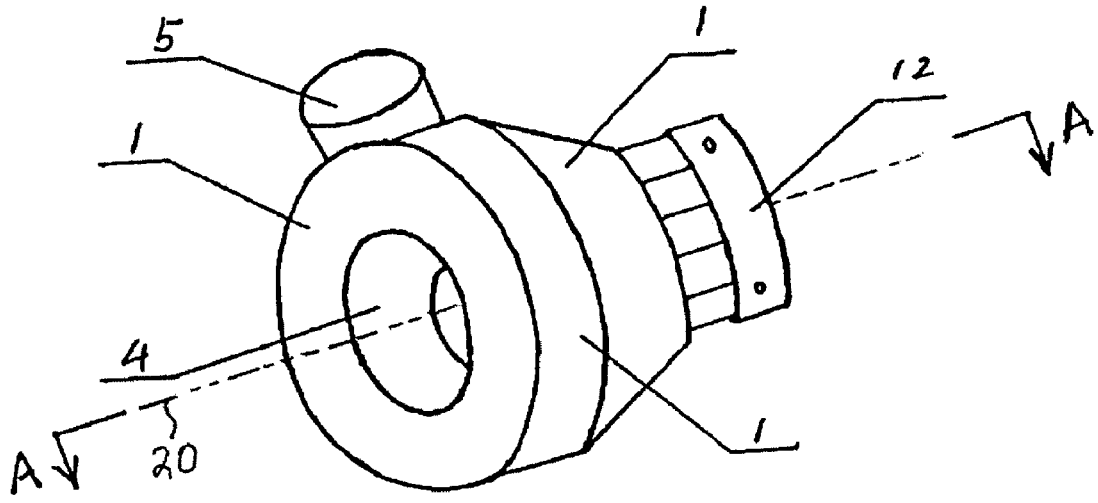
FIG. 1 is an isometric view of one embodiment of a multifunctional back-flowing strong-suction blower.
Figure 2:
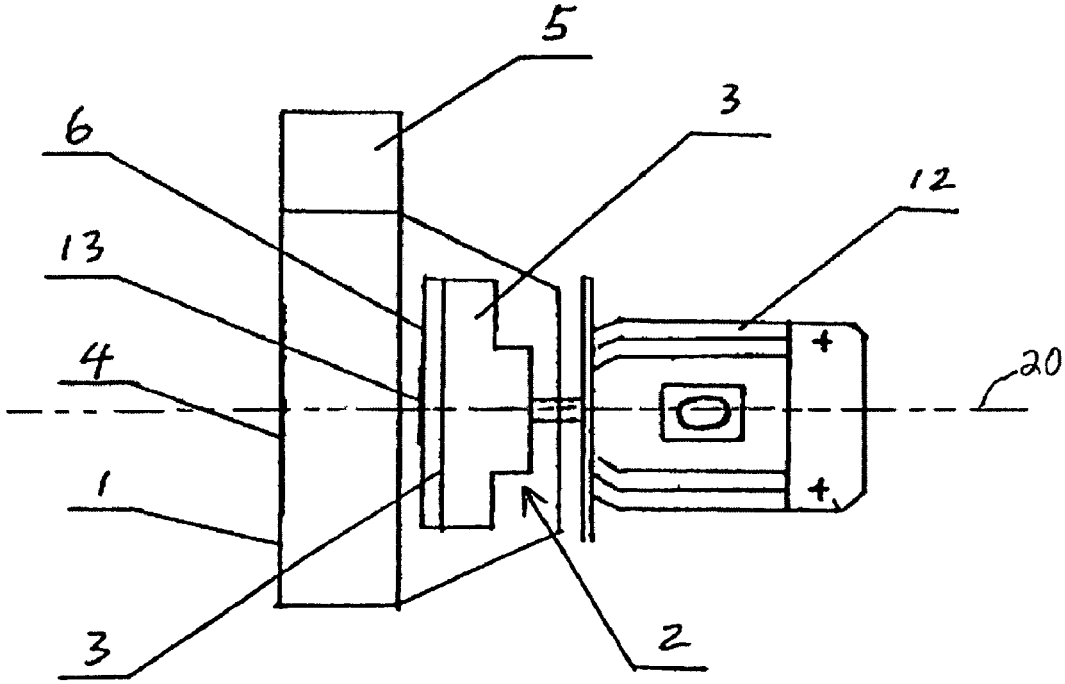
FIG. 2 is a cross section view taken along lines A-A of FIG. 1.
Figure 3:
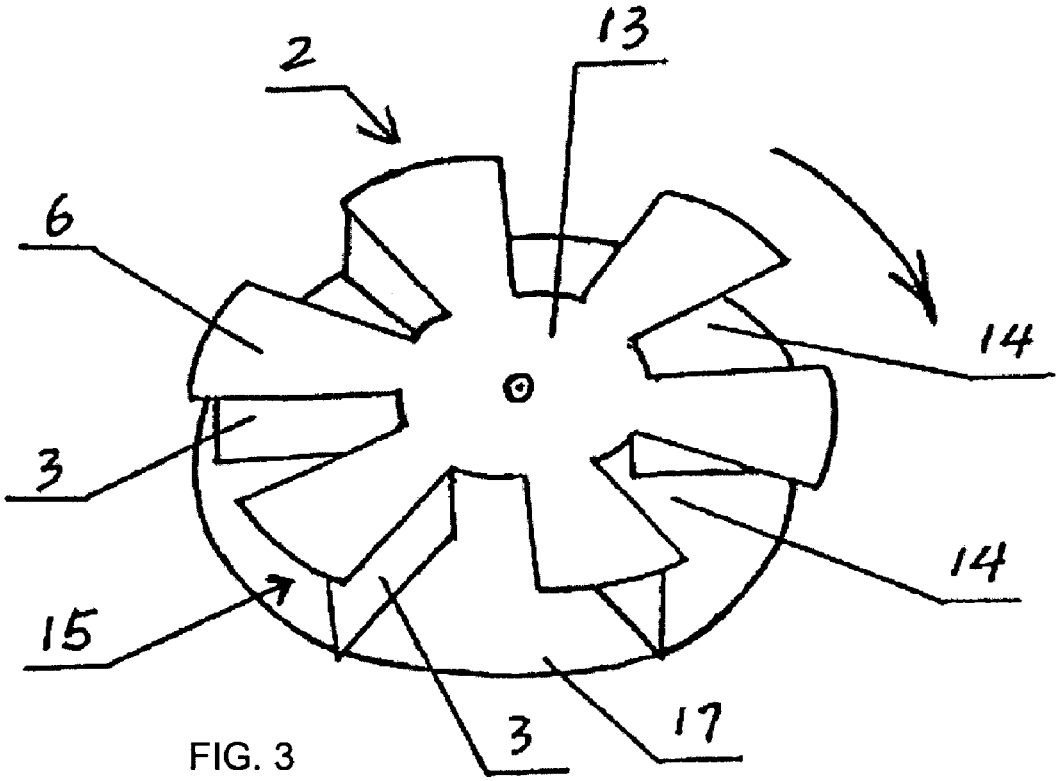
FIG. 3 is a perspective view of the impeller of the embodiment of FIG. 1.

One embodiment, shown in FIGS. 1, 2, and 3, is a multifunctional back-flowing strong-suction blower. It comprises a casing 1, an impeller 2, impeller blades 3, a back-flowing suction port 4 ("suction port 4"), a sidewall air outlet 5, and an electric motor 12. Suction port 4 and electric motor 12 are separately fixed on the axial sidewall of casing 1, relative to axis 20. The radial sidewall of casing 1 is a combination of a cylindrical taper and a cylindrical column. The cylindrical taper extends along axis 20 of impeller 2 from the front edge to the back edge of casing 1 (the side with electric motor 12 is the front edge of casing 1), and its extending end connects to the cylindrical column of casing 1. Impeller 2 is fixed in the cylindrical taper of casing 1, and sidewall air outlet 5 is located in the radial sidewall of the cylindrical column of casing 1. Suction port 4 located in the axial sidewall of casing 1 faces the rear axial surface at the back of impeller 2, which includes rear impeller disk 13. The diameter of suction port 4 is substantially equal to that of impeller 2.

Rear impeller disk 13 includes a plurality of suctionside separating plates 6. Each suctionside separating plate 6 is located on the periphery of rear impeller disk 13, connecting to the edge of each corresponding impeller blade 3 and parallel to the rear axial surface of impeller 2. Adjacent suctionside separating plates 6 do not interconnect, leaving a plurality of suction clearances 14 there between. Also, a plurality of impeller outlets 15 are defined, one each in the space between front impeller disk 17 and each suctionside separating plate 6. Each suctionside separating plate 6 on impeller 2 has the same shape, mass, and size; and each suction clearance 14 has the same shape and size. The inner diameter of rear impeller disk 13 is much smaller than that of impeller 2. Impeller 2 is also comparatively lightweight, since it is composed of less material.

During operation, impeller 2 and suction clearances 14 allow outside material to enter an air duct (between rear impeller disk 13 and front impeller disk 17) inside impeller 2 after passing through suction port 4. Material entering impeller 2 constantly absorbs the energy passed by rotating impeller blades 3, and thus speeds up. Suction on suction port 4 is produced by means of suction clearances 14. Outside material enters suction port 4, where the sucking force is doubled, and is then discharged out of casing 1 through sidewall air outlet 5 in the radial sidewall of casing 1.

Because of a diversion isolation action achieved by suctionside separating plates 6, any material sucked into the air duct inside impeller 2 will not travel to the outside of impeller 2. Conversely, in the radial rear sidewall of impeller 2, because of the high-speed material flow through impeller blades 3, the diversion isolation action achieved by the rotation of suctionside separating plates 6 will not let the majority of outside material enter the inner air duct of impeller 2. Therefore, a partial filtration process occurs whereby only certain outside material can enter the inner air duct of impeller 2. Such material needs to be of light mass and small in size. Any material above a threshold size and mass will not enter the inside of impeller 2. This embodiment may be adapted for uses such as aeration, air exchange, and sucking and discharging polluted material (or unpolluted material).

In the above embodiment, the radial sidewall of casing 1 around impeller 2 is a cylindrical taper, and sidewall air outlet 5 is located in the cylindrical sidewall connecting to the extending edge of the cylindrical taper. Sidewall air outlet 5 and impeller 2 are staggered along axis 20, so the high-speed flow discharged by impeller outlet 15 is forced toward the backside of casing 1 and into sidewall air outlet 5. Thus, there is not only suction from suction clearances 14, but also suction from the high-speed rotating flow of impeller 2, in suction port 4 in the rear axial sidewall of casing 1. Therefore, a high-suction vortex cavity forms in suction port 4, creating suction at a force and capacity that is significantly greater than that of existing blowers with the same power consumption. A "cochlear tongue" is formed by sidewall air outlet 5 and extends radially near the radial sidewall of casing 1. Because sidewall air outlet 5 and impeller 2 are staggered along axis 20, the noise made by the high-speed airflow through the cochlear tongue is minimized. So, the noise produced by this embodiment is much lower than that of other blowers. No matter how this embodiment is used, it can be high-efficiency, energy-saving, and multifunctional in meeting many commercial and consumer needs.

Figure 4:
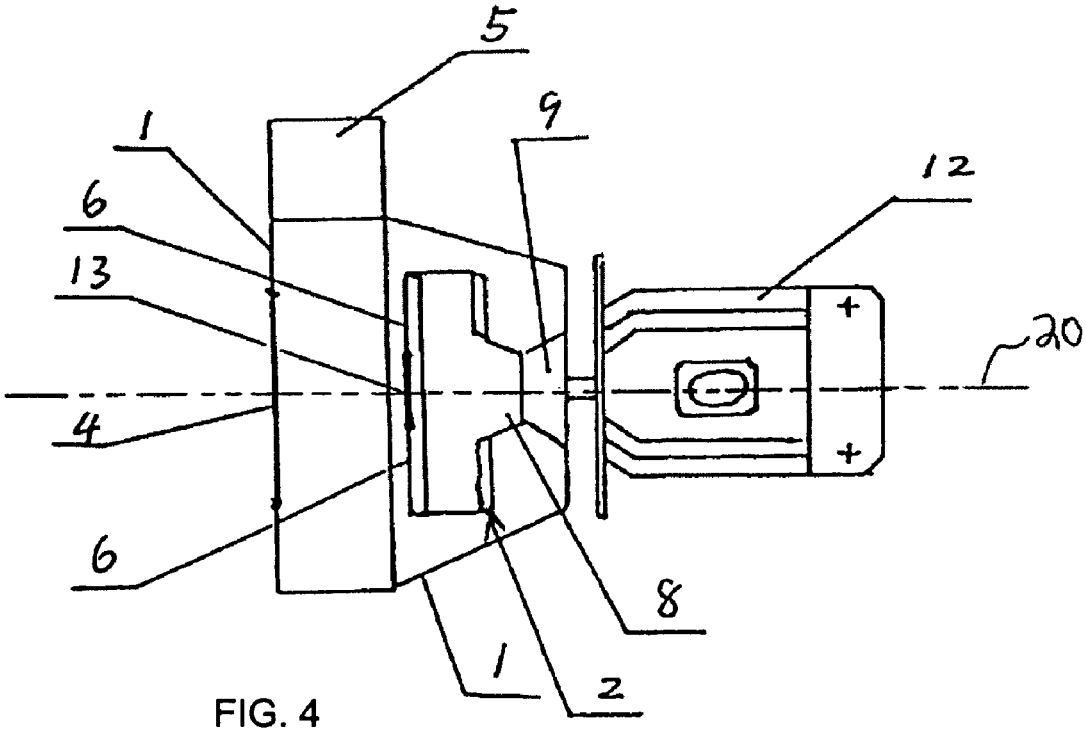
FIG. 4 is a cross section view of another embodiment of the strong-suction blower.
Figure 5:
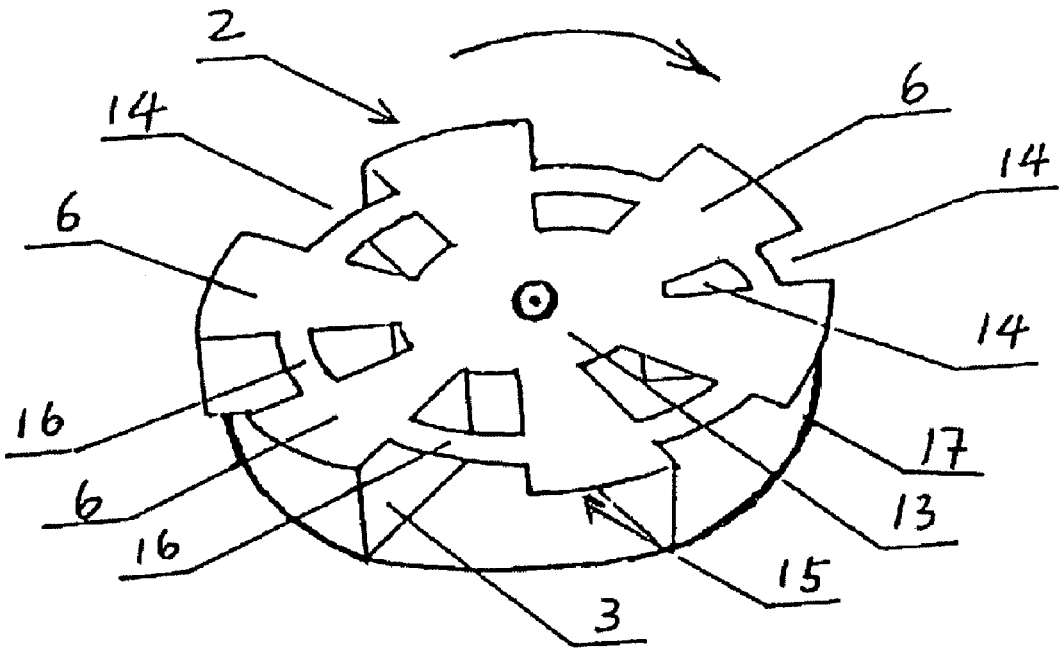
FIG. 5 is a perspective view of an embodiment of the impeller of the strong-suction blower.

Another embodiment, shown in FIGS. 4 and 5, is similar to the above embodiment. Suction clearances 14 are located between the long, inner edges of adjacent suctionside separating plates 6. Impeller blades 3 and correspondingly attached suctionside separating plates 6 may be made from an integral piece of metal, preferably iron. Each suctionside separating plate 6 on impeller 2 is equal in shape, size, and mass; and each suction clearance 14 is also equal in shape and size. Suctionside separating plate 6, in contrast with the embodiment of FIGS. 1-3, includes a plurality of reinforced bracings 16, which spans between each suctionside separating plate 6. Each reinforced bracing 16, therefore, spans corresponding suction clearances 14, thereby connecting all suctionside separating plates 6 and impeller blades 3 into an integral piece. Thus, when impeller 2 is rotating, it cannot easily be deformed and can keep running smoothly with little noise. Also in contrast, impeller 2 includes impeller inlet 8 and sidewall air inlet 9, both located in the front axial sidewall of casing 1, facing and connected to each other along axis 20.

During operation, the air sucked in by sidewall air inlet 9 and impeller inlet 8 is processed into high-speed airflow by impeller 2. The high-speed airflow passing through suction clearances 14 and impeller outlets 15 produces suction on the inside of suction port 4. The high-speed airflow sucks out material through suction port 4, and then discharges it through sidewall air outlet 5.

If sidewall air inlet 9 and suction port 4 suck the same air or material in the same environment, then the blower may be used for aeration and air exchange. If sidewall air inlet 9 sucks clean air or clean liquid and suction port 4 sucks other material, then the blower may be used for sucking and discharging either polluted or unpolluted air, liquids, or solids. The blower of FIGS. 4 and 5 can also be high-efficiency, energy-saving, and multifunctional, and may be made into manifold blowers, oil pumps, and water pumps to meet many commercial and consumer needs.

Figure 6:
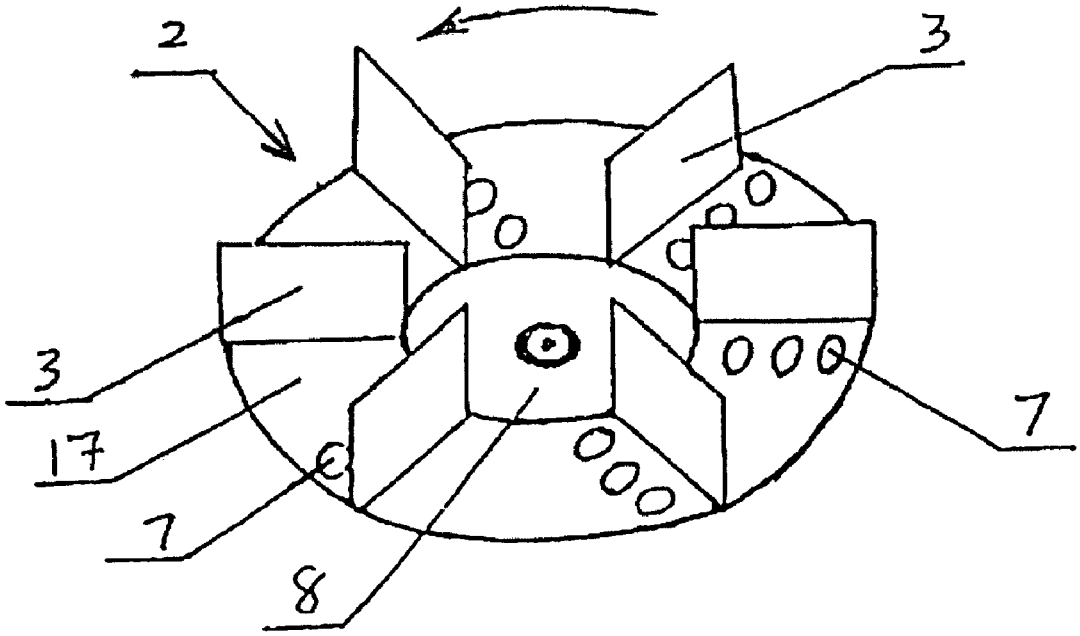
FIG. 6 is a perspective view of another embodiment of the impeller of the strong-suction blower.

FIG. 6 displays a perspective view of another embodiment of impeller 2 as shown in FIG. 5, with a few modifications. This impeller 2 does not have a rear impeller disk 13, nor are suctionside separating plates 6 attached to the edge of adjacent impeller blades 3. Also, a row of suction eyelets 7 is defined in front impeller disk 17, which allow material through impeller disk 17 and into the air duct inside impeller 2. Suction eyelets 7 may be located between each pair of adjacent impeller blades 3. Suction eyelets 7 may be sized for specific sizes depending on the material to be sucked and discharged through casing 1. Impeller 2 of FIG. 6 is easily manufactured and engineered, and has similar functions and applications to the impellers 2 mentioned earlier.

Figure 7:
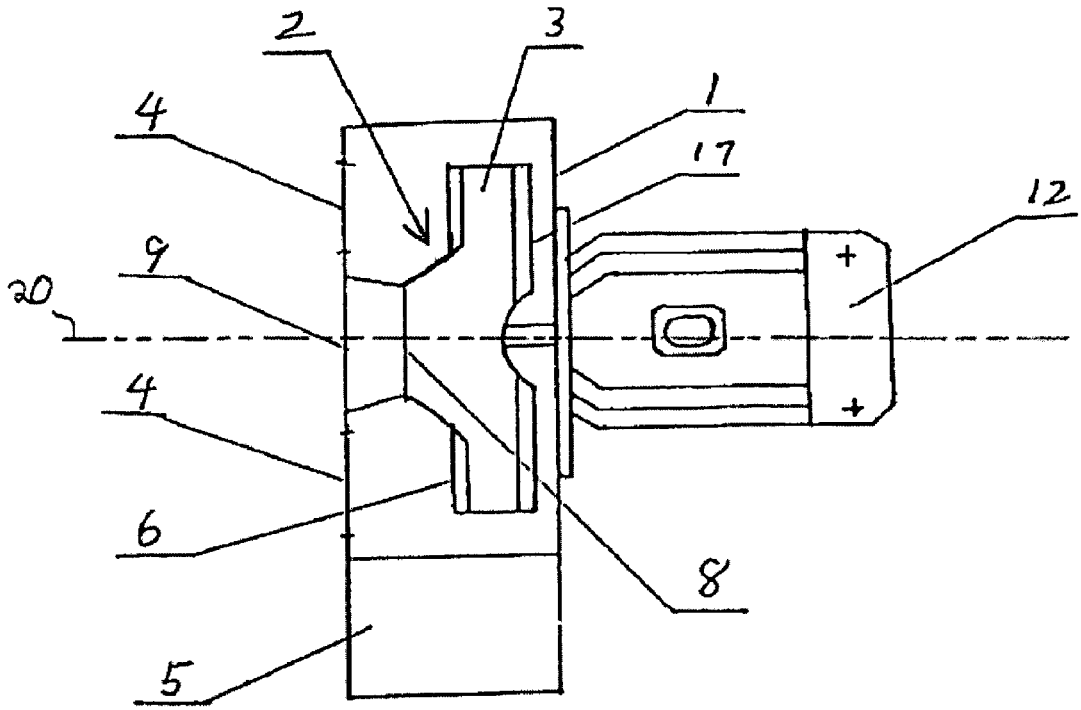
FIG. 7 is a cross section view of another embodiment of the strong-suction blower.
Figure 8:
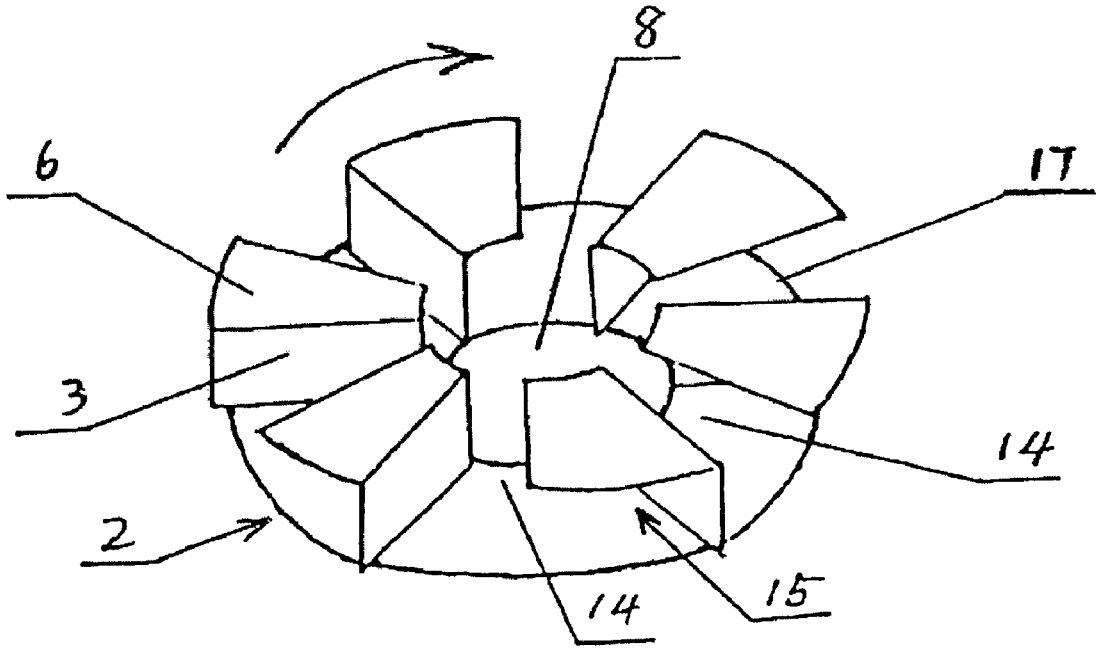
FIG. 8 is a perspective view of the impeller of the embodiment of FIG. 7.

Another embodiment of the strong-suction blower, as shown in FIGS. 7 and 8, is similar to that of FIGS. 4 and 5. The difference is that casing 1 of FIG. 7 has a volute shape. Also, sidewall air outlet 5 is located in the cochlear tongue area, which radially faces impeller 2 rather than being staggered along axis 20 with impeller 2 along the axial direction. Sidewall air inlet 9 and electric motor 12 are separately located in opposing axial sidewalls of casing 1. Annular, back-flowing suction port 4 and sidewall air inlet 9 are located in the same rear axial sidewall. Annular suction port 4 is in the periphery of sidewall air inlet 9. Suctionside separating plates 6 of impeller 2 and impeller inlet 8 are located to face the rear axial sidewall, and suctionside separating plates 6 are on the periphery of impeller inlet 8. Referring to FIG. 8, each suctionside separating plate 6 is not connected to each adjacent impeller blade 3, and adjacent suctionside separating plates 6 do not connect to each other. Finally, front impeller disk 17 is located in the front axial sidewall of impeller 2.

During operation, sidewall air inlet 9 and suction port 4 suck the same from the same environment. Because the blower uses not only the suction of impeller inlet 8, but also the suction formed by the high-speed airflow in the air duct of impeller 2 to suck in material, the suction force and the suction capacity of the blower can be significantly greater than those of a blower that depends only on an air inlet. Using this technique, a blower with especially strong-suction force can be made to meet the needs of many applications in various environments and conditions.

Figure 9:
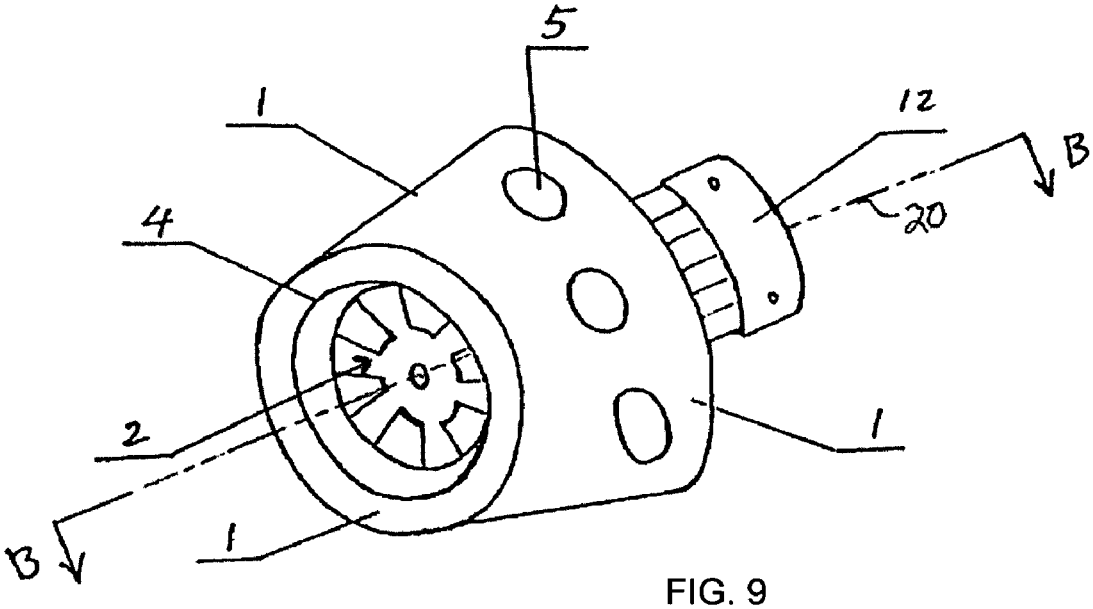
FIG. 9 is an isometric view of another embodiment of the strong-suction blower.
Figure 10:
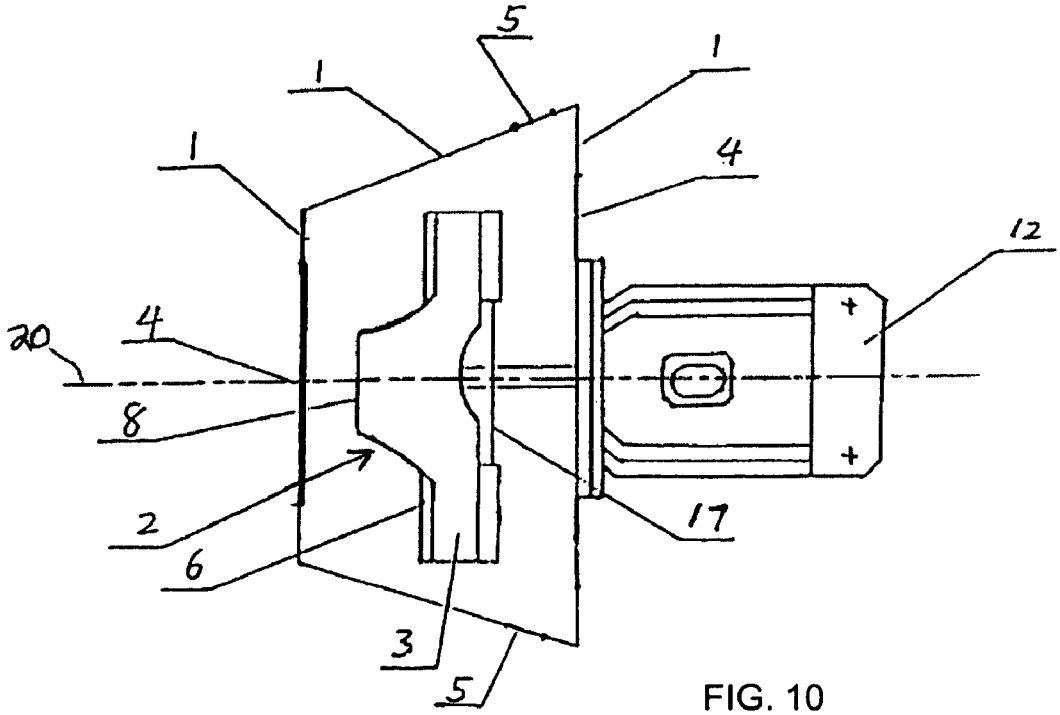
FIG. 10 is a cross section view taken along lines B-B of FIG. 9.
Figure 11:
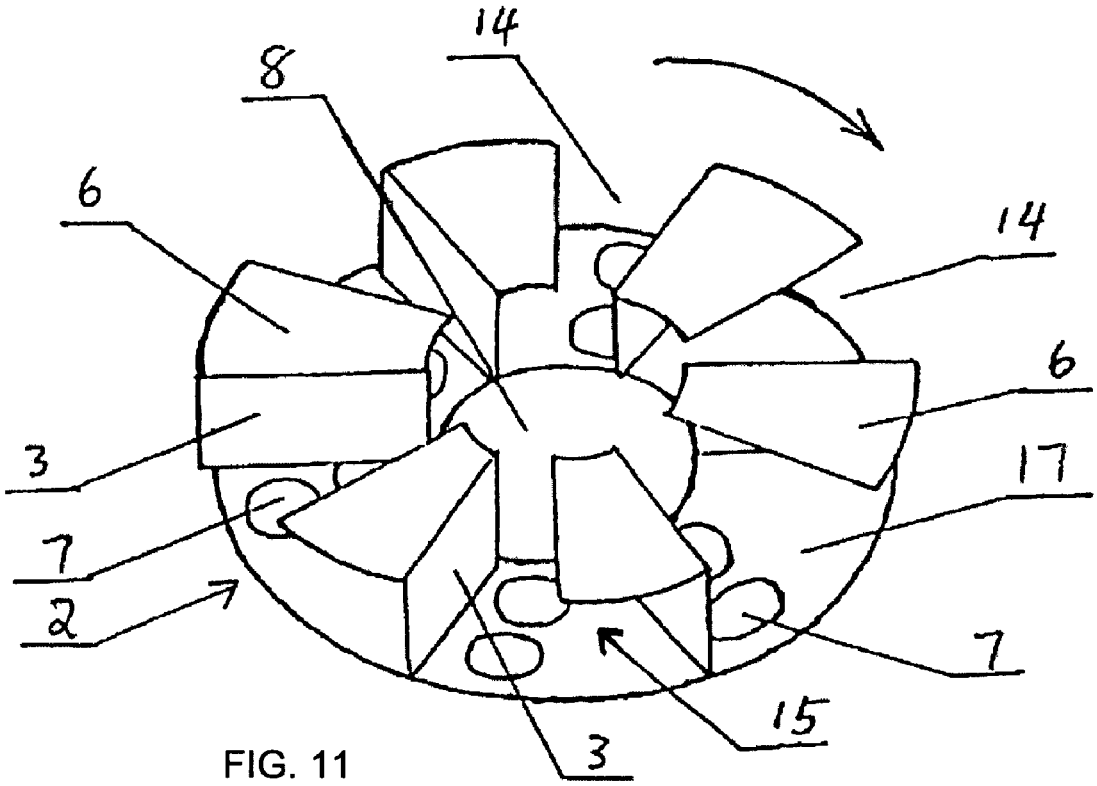
FIG. 11 is a perspective view of the impeller of the embodiment of FIG. 9.

Another embodiment of the strong-suction blower, shown in FIGS. 9, 10, and 11, is similar to that of FIGS. 7 and 8. The difference is that the radial sidewall of casing 1 is a cylindrical taper. The entire cylindrical taper extends from the back of casing 1 to the front of casing 1. Six sidewall air outlets 5 are radially located in the larger end of the cylindrical taper. Impeller 2 is fixed on the inside of the smaller end of the cylindrical taper. Therefore, impeller 2 and sidewall air outlets 5 are axially staggered along axis 20. Suction ports 4 are located in both axial sidewalls of casing 1. Suction ports 4 of the rear axial sidewall of impeller 2, which is located on the inside of suction ports 4. Suction port 4 on the front axial sidewall of casing 1 is annular, and suctionside separating plates 6 are located on the rear axial sidewall of impeller 2, which is in the periphery of impeller inlet 8. Suction clearances 14 are located between adjacent pairs of suctionside separating plates 6 and corresponding impeller blades 3. Impeller blades 3 extend from the front axial surface of impeller 2, and suctionside separating plates 6 are located on the periphery of each impeller blade 3. Suctionside separating plates 6 each connect to corresponding edges of adjacent impeller blades 3, and suction eyelets 7 are located in front impeller disk, between each pair of adjacent impeller blades 3.

During operation, suction ports 4 in the opposing axial sidewalls of casing 1 both suck in material simultaneously. A large flow is discharged out of casing 1 through the six sidewall air outlets 5. This embodiment can be favorably adapted for use in fan blowers and special fans.

Figure 12:
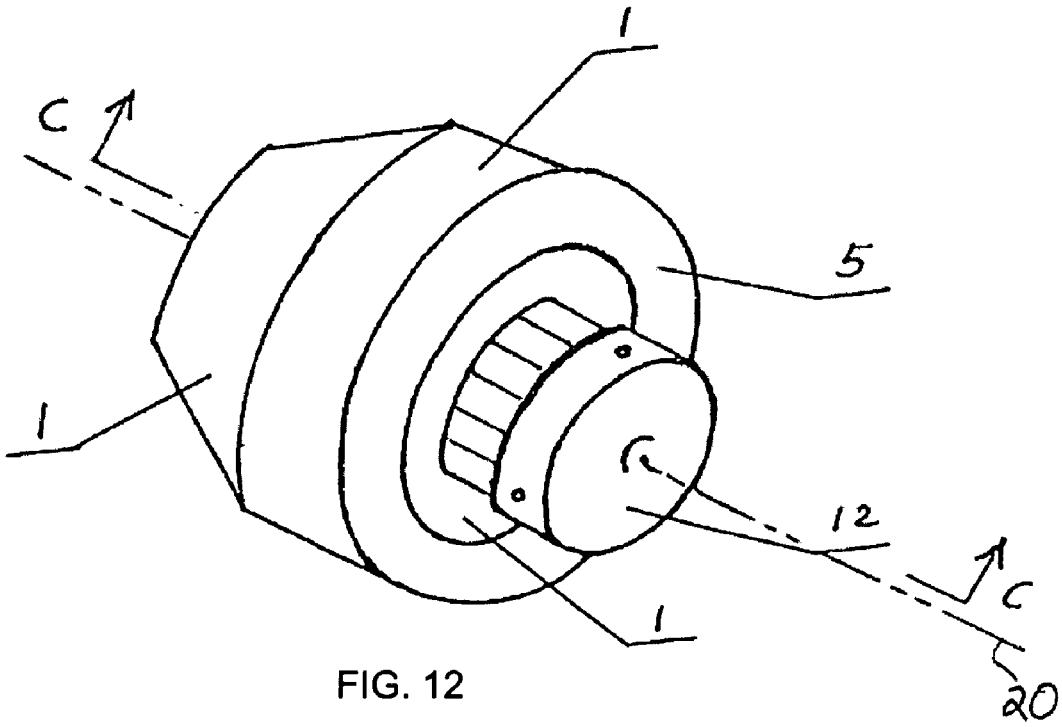
FIG. 12 is an isometric view of another embodiment of the strong-suction blower.
Figure 13:
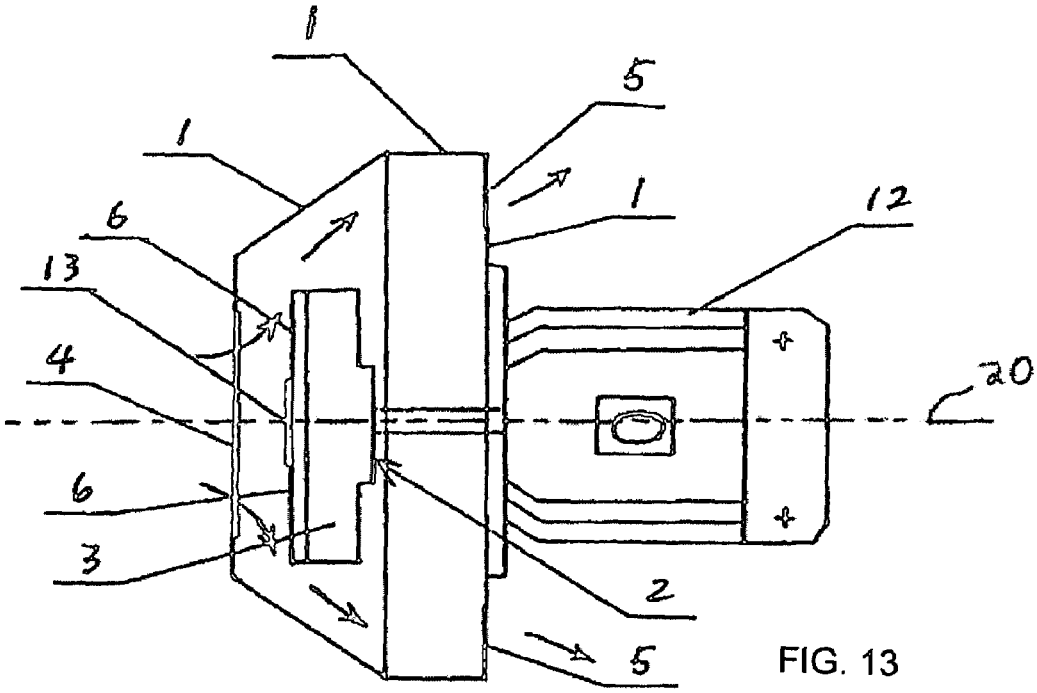
FIG. 13 is a cross section view taken along lines C-C of FIG. 12.

Another embodiment of the strong-suction blower, shown in FIGS. 3, 12, and 13, is similar to that of FIGS. 1-3. The difference is that the radial sidewall of casing 1 is a combination of a cylindrical taper and a cylindrical column. The cylindrical taper extends from the back of casing 1, to the front of casing 1, along axis 20. Also, impeller 2 is fixed in the inside of the cylindrical taper. Sidewall air outlet 5 is annular and is housed in the front axial sidewall of casing 1.

During operation, suction ports 4 suck in material by means of the suction created between impeller blades 3 inside the front of impeller 2 and the suction formed by suction clearances 14 of the rear of impeller 2. The material is then discharged out of casing 1 through annular sidewall air outlet 5 in the front axial sidewall. Material that is small enough in size and mass can enter impeller 2 during operation. This blower may be adapted for use as a back-flowing axial flow blower. The airflow and air pressure through the casing are quite large.

Figure 14:
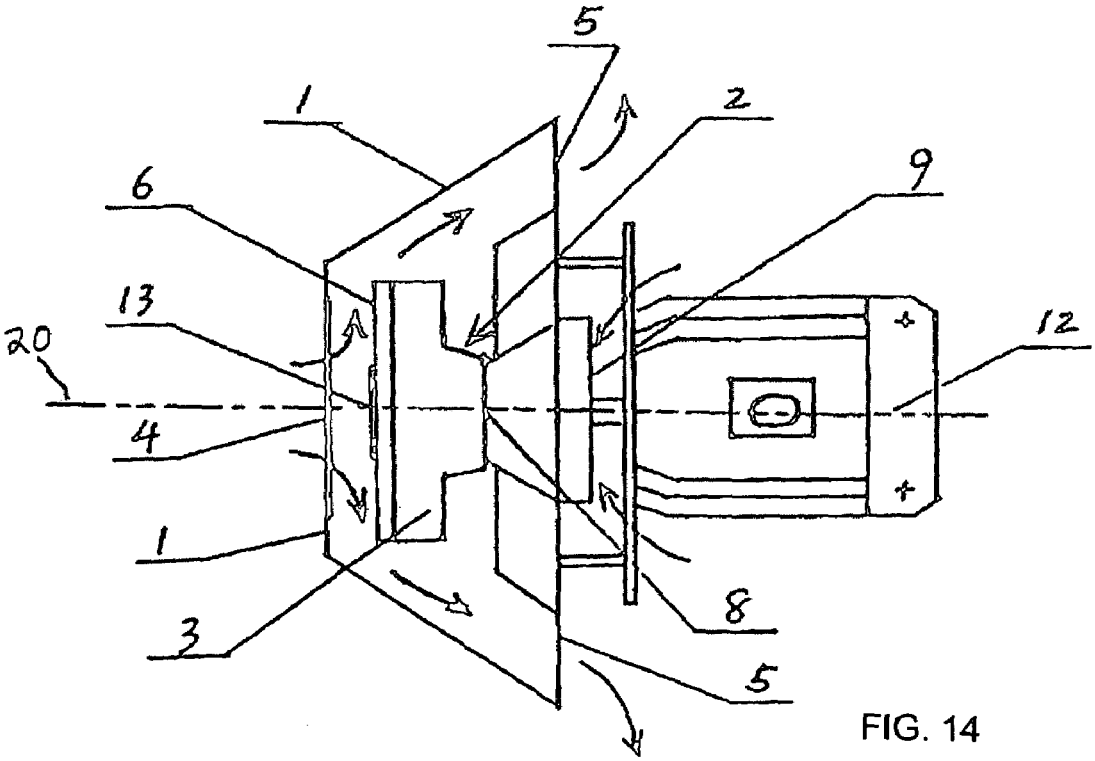
FIG. 14 is a cross section view of another embodiment of the strong-suction blower.

Yet another embodiment of the strong-suction blower, shown in FIGS. 3 and 14, is similar to that of FIG. 13. The difference is that both impeller inlet 8 and sidewall air inlet 9 are located in the front axial sidewall. Impeller inlet 8 faces and connects to the axial sidewall surface of sidewall air inlet 9. Another difference is that the radial sidewall of casing 1 is a simple cylindrical taper. Annular axial sidewall air outlet 5 is located in the axial sidewall of the larger end of the cylindrical taper.

During operation, the air passing from sidewall air inlet 9 and impeller inlet 8 into impeller 2 is processed into high-speed airflow by impeller 2. The high-speed airflow produces suction by means of suction clearances 14 and impeller outlet 15, which prompt suction port 4 to suck in material. The sucked material does not enter impeller 2, but rather enters the inside of the cylindrical taper, and is then discharged out of casing 1 through annular sidewall air outlet 5. Material discharged through annular sidewall air outlet 5 continues rotating and therefore does not re-enter sidewall air inlet 9.

During operation, if sidewall air inlet 9 sucks clean air and suction port 4 sucks polluted air, the polluted air does not enter impeller 2. This is due to the high-pressure build up in casing 1 from the designed airflow of this embodiment. Therefore, impeller 2 is protected from pollution and corrosion, making the blower of FIG. 14 ideal for pollution discharge and dust removal, as well as lampblack removal and other similar applications.

Figure 15:
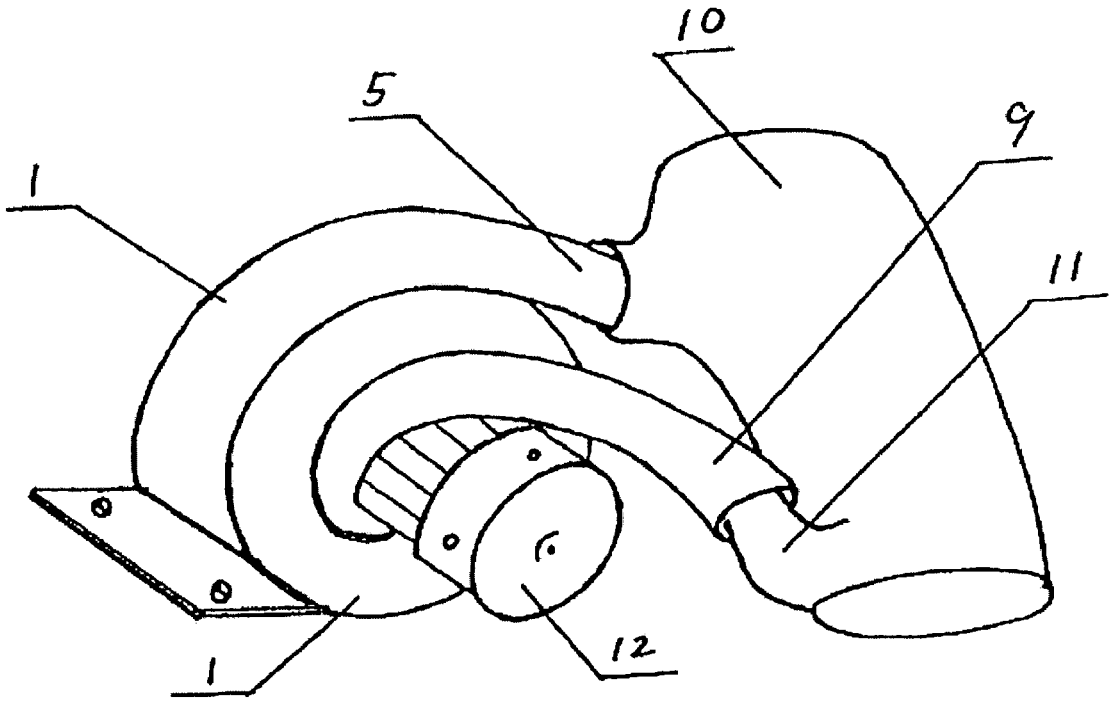
FIGS. 15 and 16 are isometric views of further embodiments of the strong-suction blower.

Another embodiment of the strong-suction blower, shown in FIGS. 4, 5, and 15, is similar to that of FIGS. 4 and 5. The difference is that a sack-like connecting vessel 10 is located on the outside of casing 1. The inlet of connecting vessel 10 is coupled to sidewall air outlet 5, and outlet 11 of connecting vessel 10 is coupled with sidewall air inlet 9. Connecting vessel 10 may be made of thin and dense textiles, and outlet 11 may have a filtration net (not shown).

During operation, material sucked into suction port 4 enters connecting vessel 10 after being discharged from casing 1 (some air can permeate a plurality of thin, dense eyelets (not shown) located in the filtration net. After being filtered by the filtration net of outlet 11 of connecting vessel 10, solid material is left in connecting vessel 10; air enters sidewall air inlet 9 and impeller 2 through outlet 11, and is then processed into high-speed airflow. The high-speed airflow forms the suction in suction clearances 14 to suck in material. This process establishes a cyclic suction state, providing constant suction. This embodiment can be adapted for uses such as for cleaners, mechanical sweepers, and vacuum cleaners.

Another embodiment of the strong-suction blower, shown in FIGS. 1, 2, 3, and 16, is similar to that of FIGS. 1-3. The difference is that a box-like connecting vessel 18 is located on the outside of casing 1. The inlet of connecting vessel 18 connects to sidewall air outlet 5, and outlet 11 of connecting vessel 18 connects to suction port 4. A filtration net (not shown) is located in connecting vessel 18. While material discharged through sidewall air outlet 5 is filtered, the air is discharged into the area between the outside of the filtration net and inside the wall of connecting vessel 10. Then the air is discharged into suction port 4 through outlet 11 of connecting vessel 18 and sucked into casing 1 by suction port 4. This process establishes a cyclic suction state, providing constant suction.

This embodiment can be adapted for use in mechanical sweepers and vacuum cleaners. During operation, dusty air discharged through connecting vessel 18 is sucked into casing 1 again, to further filter the polluted air.

Figure 16:
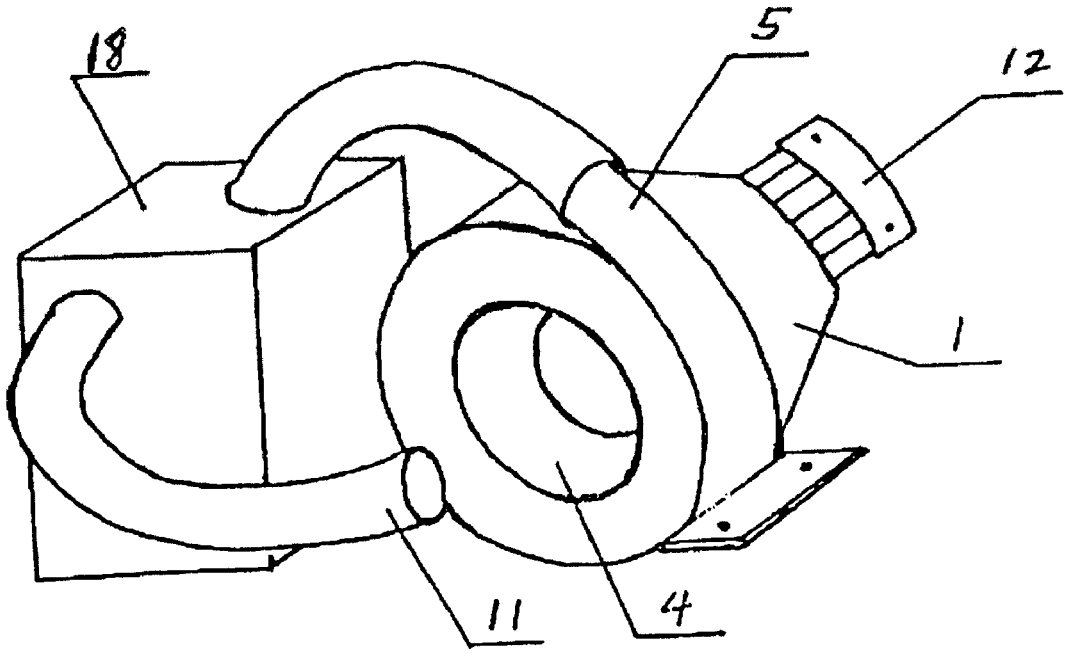

Another embodiment of the strong-suction blower, shown in FIGS. 15 and 16, is similar to the previous two embodiments. The difference is that connecting vessels 10 and 18 each have two outlets 11, one of which connects to sidewall air inlet 9, and the other of which connects to suction port 4. During operation, dusty air discharged through connecting vessel outlet 11 is sucked again into casing 1 by sidewall air inlet 9 and suction port 4, and is then filtered by connecting vessel 10 or 18, and discharged out of the casing, which establishes another cyclic suction state.

The terms and descriptions used herein are set forth by way of illustration only and are not meant as limitations. Those skilled in the art will recognize that many variations can be made to the details of the above-described embodiments without departing from the underlying principles of the invention. The scope of the invention should therefore be determined only by the following claims (and their equivalents) in which all terms are to be understood in their broadest reasonable sense unless otherwise indicated.

The invention claimed is:

1. A multifunctional blower for material, comprising:

a casing having front and rear axial sidewalls between which extends a longitudinal axis, and a radial sidewall formed between the front and rear axial sidewalls;

an impeller located inside the casing comprising:

an air duct formed generally through the center of the impeller;

a front disk having a plurality of radially spaced-apart blades oriented laterally to the front disk and radially about the air duct; and a plurality of suctionside separating plates attached to corresponding edges of each blade, the impeller being radially driven about the longitudinal axis, wherein the plurality of suctionside separating plates define a plurality of suctionside clearances therebetween that connect to the air duct;

a suction port located in at least one of the front and rear axial sidewalls through which to suck material into the casing in response to a suction generated by the impeller; and at least one sidewall air outlet in at least one of the sidewalls of the casing, to provide an escape for the material not pulled into the air duct.

2. The blower of claim 1, further comprising a plurality of impeller outlets defined between the suctionside separating plates and the rear disk to discharge material from the impeller toward the sidewall air outlet.

3. The blower of claim 1, further comprising a sidewall air inlet through one of the front and rear axial sidewalls of the casing.

4. The blower of claim 3, further comprising an impeller inlet connecting the sidewall air inlet to the air duct of the impeller.

5. The blower of claim 3, further comprising a connecting vessel comprising:

a vessel inlet coupled to the sidewall air outlet;

a vessel outlet coupled to the sidewall air inlet, thereby generating cyclic suction through the casing and the connecting vessel; and a filtration net for filtering out recirculated material from the casing.

6. The blower of claim 1, wherein the impeller and the at least one sidewall air outlet are spaced apart a distance along the longitudinal axis, wherein high-speed flow of material discharged from the impeller is forced out the at least one sidewall air outlet.

7. The blower of claim 1, wherein the plurality of suctionside separating plates are interconnected by a plurality of corresponding reinforced bracings formed therebetween.

8. The blower of claim 7, wherein at least one of the plurality of reinforced bracings interconnect at least one suctionside separating plate with the impeller blade of an adjacent suctionside separating plate.

9. The blower of claim 1, wherein through the front impeller plate is defined at least one eyelet between at least one adjacent set of impeller blades.

10. The blower of claim 1, further comprising a rear impeller plate, wherein the plurality of suctionside separating plates are radial, spaced-apart extensions of the rear impeller plate.

11. The blower of claim 1, wherein the radial sidewall of the casing includes a cylindrical tapered portion and a cylindrical columned portion, wherein the impeller is located within the cylindrical tapered portion and the at least one sidewall air outlet is defined through the cylindrical columned portion.

12. The blower of claim 1, wherein each suctionside separating plate is tilted at an angle with respect to each corresponding impeller blade.

13. A multifunctional blower for material, comprising:

a casing having front and rear axial sidewalls between which extends a longitudinal axis, and a radial sidewall formed between the front and rear axial sidewalls;

an impeller located inside the casing and driven radially about the longitudinal axis, the impeller having an air duct through the center thereof and a front disk having a plurality of radially spaced-apart blades oriented laterally to the front disk and radially about the air duct, wherein the front disk defines at least one eyelet between each adjacent set of spaced-apart blades through which material can flow;

an impeller inlet extending the air duct toward at least one of the front and rear axial sidewalls;

a suction port located in at least one of the front and rear axial sidewalls through which to suck material into the casing in response to a suction generated by the impeller; and at least one sidewall air outlet in at least one of the sidewalls of the casing, to provide an escape for the material not pulled into the air duct.

14. The blower of claim 13, further comprising a rear impeller disk having a disk portion in the center and a plurality of suctionside separating plates formed in the periphery of the impeller disk, each suctionside separating plate attached to a corresponding impeller blade edge.

15. The blower of claim 13, further comprising a plurality of suctionside separating plates attached to the edges of the impeller plates, wherein formed between each adjacent suctionside separating plate is a suction clearance that connects to the air duct.

16. The blower of claim 15, wherein at least one suctionside separating plate is oriented at an angle with its corresponding blade.

17. The blower of claim 13, further comprising a sidewall inlet extending the impeller inlet to the at least one of the front and rear axial sidewalls.

18. The blower of claim 13, wherein the impeller and the at least one sidewall air outlet are spaced apart a distance along the longitudinal axis, wherein high-speed flow of material discharged from the impeller is forced out the at least one sidewall air outlet.

19. The blower of claim 13, further comprising a connecting vessel comprising:

an inlet coupled to the sidewall air outlet;

an outlet coupled to the sidewall air inlet, thereby generating cyclic suction through the casing and the connecting vessel; and a filtration net for filtering out recirculated material from the casing.

20. The blower of claim 13, wherein the radial sidewall of the casing includes a cylindrical tapered portion and a cylindrical columned portion, wherein the impeller is located within the cylindrical tapered portion and the at least one sidewall air outlet is defined through the cylindrical columned portion.

* * * * *